US007786840B2

(12) United States Patent
Nord

(10) Patent No.: US 7,786,840 B2
(45) Date of Patent: Aug. 31, 2010

(54) OPTIMAL PACKAGING GEOMETRIES OF SINGLE AND MULTI-LAYER WINDINGS

(76) Inventor: Jonathan Nord, 38 R Enon St., Apartment 214, Beverly, MA (US) 01915

( * ) Notice: Subject to any disclaimer, the term of this patent is extended or adjusted under 35 U.S.C. 154(b) by 559 days.

(21) Appl. No.: 11/426,310

(22) Filed: Jun. 25, 2006

(65) Prior Publication Data

US 2006/0290459 A1 Dec. 28, 2006

Related U.S. Application Data

(60) Provisional application No. 60/693,828, filed on Jun. 24, 2005.

(51) Int. Cl.
*H01F 27/28* (2006.01)

(52) U.S. Cl. ..... 336/223; 336/232

(58) Field of Classification Search ..... 336/223
See application file for complete search history.

(56) References Cited

U.S. PATENT DOCUMENTS 3,187,208 A 6/1965 Van De Graff
4,587,606 A 5/1986 Sanada
4,837,544 A 6/1989 McDougal
5,124,658 A 6/1992 Adler
5,760,669 A 6/1998 Dangler et al.
5,991,178 A 11/1999 Arnould
6,559,751 B2 * 5/2003 Liu et al. ..... 336/223
6,879,235 B2 4/2005 Ichikawa
7,132,921 B2 * 11/2006 Eguchi et al. ..... 336/200

* cited by examiner

*Primary Examiner*—Elvin G Enad
*Assistant Examiner*—Joselito Baisa
(74) *Attorney, Agent, or Firm*—Lafkas LLC; David M. Lafkas; Matthew E. Vale

(57) ABSTRACT

The present invention is an optimized geometry for stacking multiple windings, where each winding multiple-turn coil having both a start lead and a finish lead on a perimeter of the coil. The start lead of each winding of the stack is indexed respective of adjacent windings of the stack.

20 Claims, 6 Drawing Sheets

OPTIMAL PACKAGING GEOMETRIES OF SINGLE AND MULTI-LAYER WINDINGS

CROSS-REFERENCE TO RELATED APPLICATION

This application for a patent claims priority to U.S. Provisional Patent Application No. 60/693,828 as filed Jun. 24, 2005.

BACKGROUND

The present invention relates to compact, efficient transformer secondaries, and more particularly, to compact, efficient transformer secondaries having substantially optimized windings geometries in which the windings are indexed respective to adjacent windings.

Design of compact efficient transformer secondaries requires optimized usage of the area inside the magnetic path leading to minimization of coil resistances under the resulting, transient current conditions. In high voltage switch mode transformers, for example, the need to avoid excessive parasitic capacitance and large voltage output on each secondary may lead to a transformer design with a multitude of lower voltage secondaries whose outputs are series-connected to obtain the requisite high voltage.

Conventional transformer secondaries generally comprise a core material capable of containing magnetic flux, such as a soft iron or other similar material, a primary winding and secondary winding, each of which is disposed over the core material. These coils are generally constructed with the secondary winding formed by wrapping successive helical layers of an electrical conductor over the core material or other forming structure until the desired number of turns is established. Typically, each helical layer of such a construction will consist of several turns of the electrical conductor laid side by side extending longitudinally along the core material with the next layer beginning at the opposite end and traveling longitudinally back over the first layer. Such prior art is exemplified in FIG. 1. The electrical conductor normally used is commonly referred to as magnet wire and is a copper wire generally insulated with a coating of enamel or other like material thereon. In operation, each turn of the secondary coil winding will have induced in it a voltage produced by the changing magnetic field which links that turn and which is generated by changes in the current flowing in the primary winding. This magnetic field will induce approximately an equal amount of voltage in each successive turn of the winding, but as the individual turns are all serially connected, the voltage of each turn will be added to that induced in each preceding turn. Thus, it becomes apparent that while the turn-to-turn voltage gradient within the coil may be small, as the total number of turns within each layer increases, the layer-to-layer voltage gradient, being composed of the sum of the turn-to-turn voltage gradients within each layer of two adjacent radially disposed layers, will be of a considerable magnitude. This is particularly true when successive layers are wound with alternating longitudinal travel, that is, the first layer is wound with successive turns traveling from right to left with the next layer having successive turns traveling longitudinally from left to right. In this construction, the layer-to-layer voltage at the beginning end of the winding will be the sum of the turn-to-turn gradients for two complete layers of winding.

Although a multiple secondary approach can address excessive parasitic capacitance and large output voltage on each secondary, such designs using conventional wire and PCB coil forming techniques may result in physically large assemblies of fixturing for the many winding layers, starts, finishes, and layer transitions. This is especially true in high voltage power supplies above 30 kV where the designer may be interested in minimizing corona inception and thus may chose to use individual secondary voltages below 1 kV.

Low profile electronic components exist in the prior art, but most low profile designs are centered around "planar" designs formed from alternate layers of insulating material and copper foil or techniques involving coils formed on multiple layers of printed circuit board materials. These prior art designs, some of which are described above, involve a high cost and also have production disadvantages. Furthermore, typical printed circuit board insulators are considered inferior to those available on insulted winding wires.

Thus, what is desired is an optimized winding geometry which can be fixtured for compact implementation of a multitude of separate windings coupled to a common magnetic circuit. Such a desired winding geometry may include an index between adjacent layers where a conductor from one end of the coil may cross the adjacent turns and meet the conductor existing at the end of the turn at the opposite end of the layer, thereby substantially decreasing dimensional stack up of subsequent layers of such windings.

SUMMARY

The various exemplary embodiments of the present invention include a stack of two or more windings within a magnetic circuit. Each winding is comprised of a multiple-turn coil having a start lead and a finish lead. The multiple-turn coil extends inward or outward from a center region. A first turn of the coil is connected to the start lead and has a smallest perimeter from the center region and at least one subsequent turn of the coil has a progressively greater perimeter, such that the start lead passes over or under adjacent larger turns of the coil to extend to the exterior perimeter of the winding, or the finish lead passes over or under adjacent larger turns of the coil to extend to the interior of the winding. The location of an extension of either the start lead or the finish lead of each winding of the stack are varied along the perimeter with respect to each adjacent winding of the stack.

BRIEF DESCRIPTION OF DRAWINGS

The various exemplary embodiments of the present invention, which will become more apparent as the description proceeds, are described in the following detailed description in conjunction with the accompanying drawings, in which.

DETAILED DESCRIPTION

Figure 2:
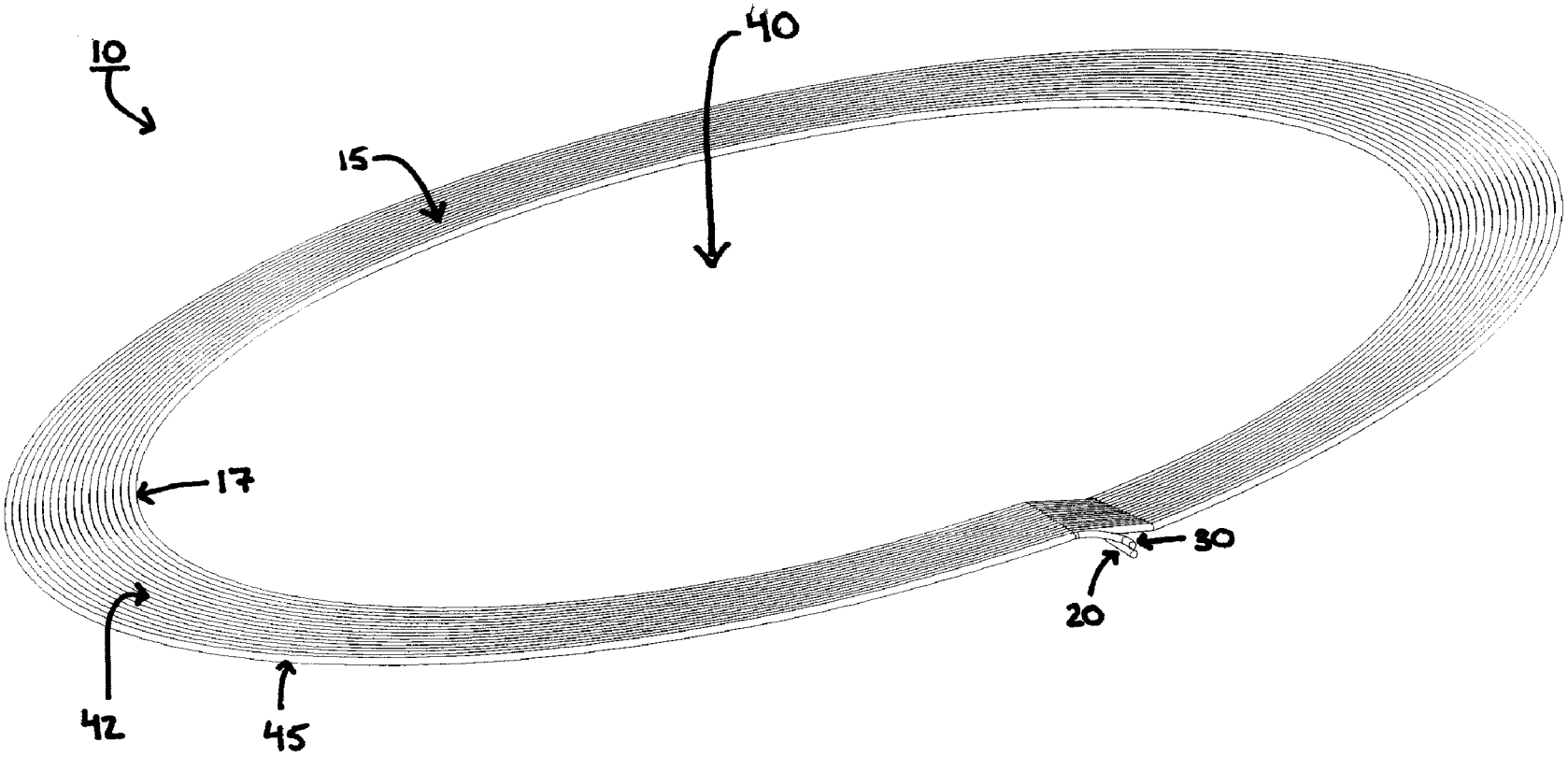
FIG. 2 is an illustration of an embodiment of a multiple-turn coil according to the present invention.

The various embodiments of the present invention include a single layer winding illustrated in FIG. 2. In this embodiment, the winding 10 is comprised of a multiple-turn coil 15 having a start lead 20 and a finish lead 30. The multiple-turn coil extends outward from a center region 40.

A winding layer, herein, is defined as a conductor formed into coils of arbitrary geometry, that is, for example, elliptical, polygonal, etc.

A first turn 17 of the multiple-turn coil 15 has a smallest perimeter as compared to subsequent turns of the multiple-turn coil. As such, the first turn is the turn of the multiple-turn coil closest to the center region, and each subsequent turn of the multiple-turn coil has a progressively greater perimeter as compared to the immediately preceding turn of the multiple-turn coil.

The actual number of turns of the multiple-turn coil is limited by the predetermined physical parameters of the space in which the multiple-turn coil will be situated in a transformer secondary for a particular function. However, it is preferred that there are at least three turns in the multiple-turn coil.

In a preferred embodiment, both the start lead 20 and the finish lead 30 of the multiple-turn coil are located on an exterior 45 of the multiple-turn coil. The start lead is directly connected to the first turn 17 of the multiple-turn coil, and passes either over a top side 42 of the multiple-turn coil or a bottom side 44.

Figure 3:
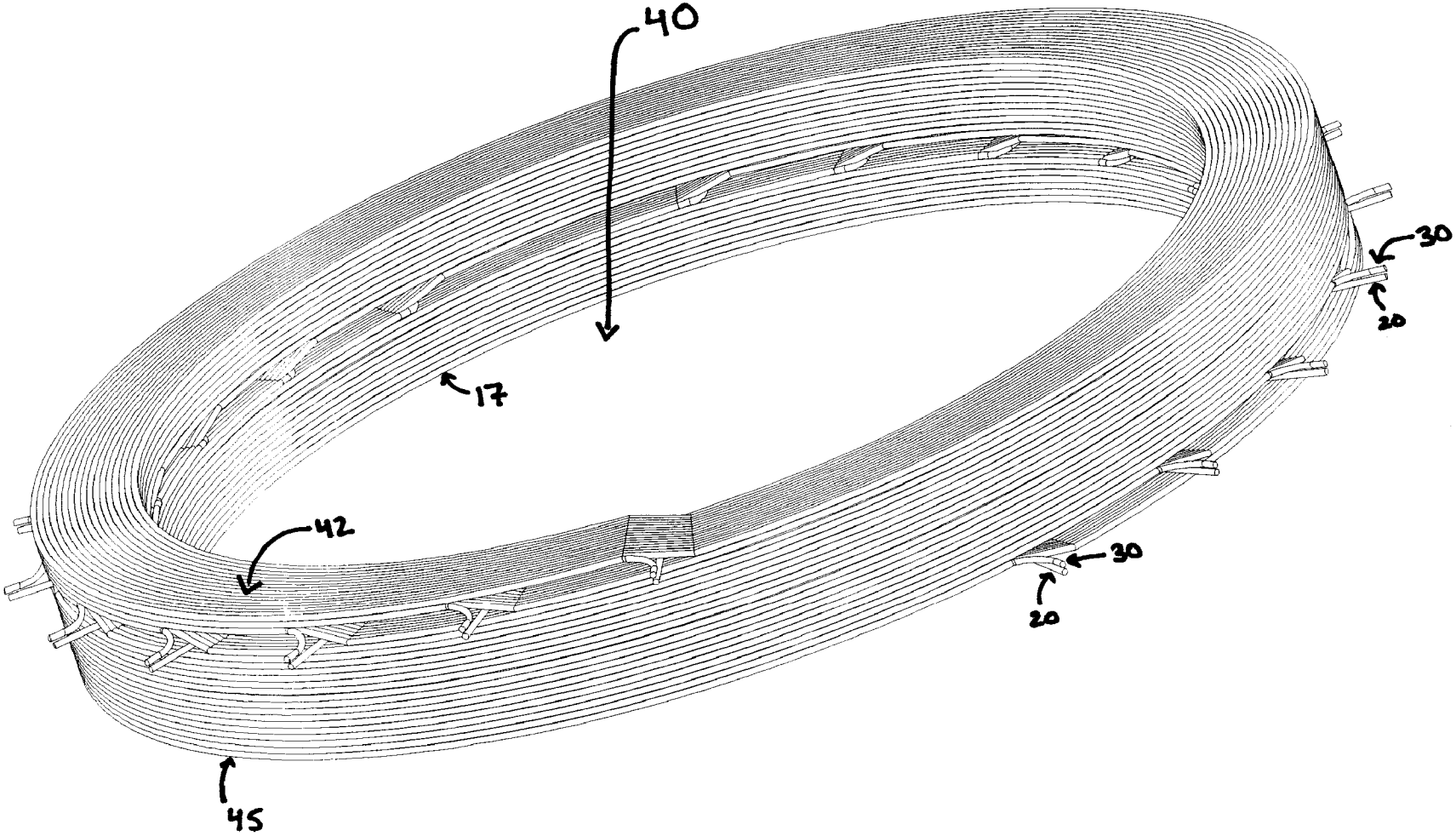
FIG. 3 is an illustration of an embodiment of the present invention having multiple-turn coils stacked on top of one another.

FIG. 3. illustrates the various exemplary embodiments in which two or more windings according to the present invention are stacked such that the top side of a first winding is adjacent to the bottom side of a second winding. The top side of the second winding would then be adjacent to the bottom side of a third winding, and so on.

Figure 4:
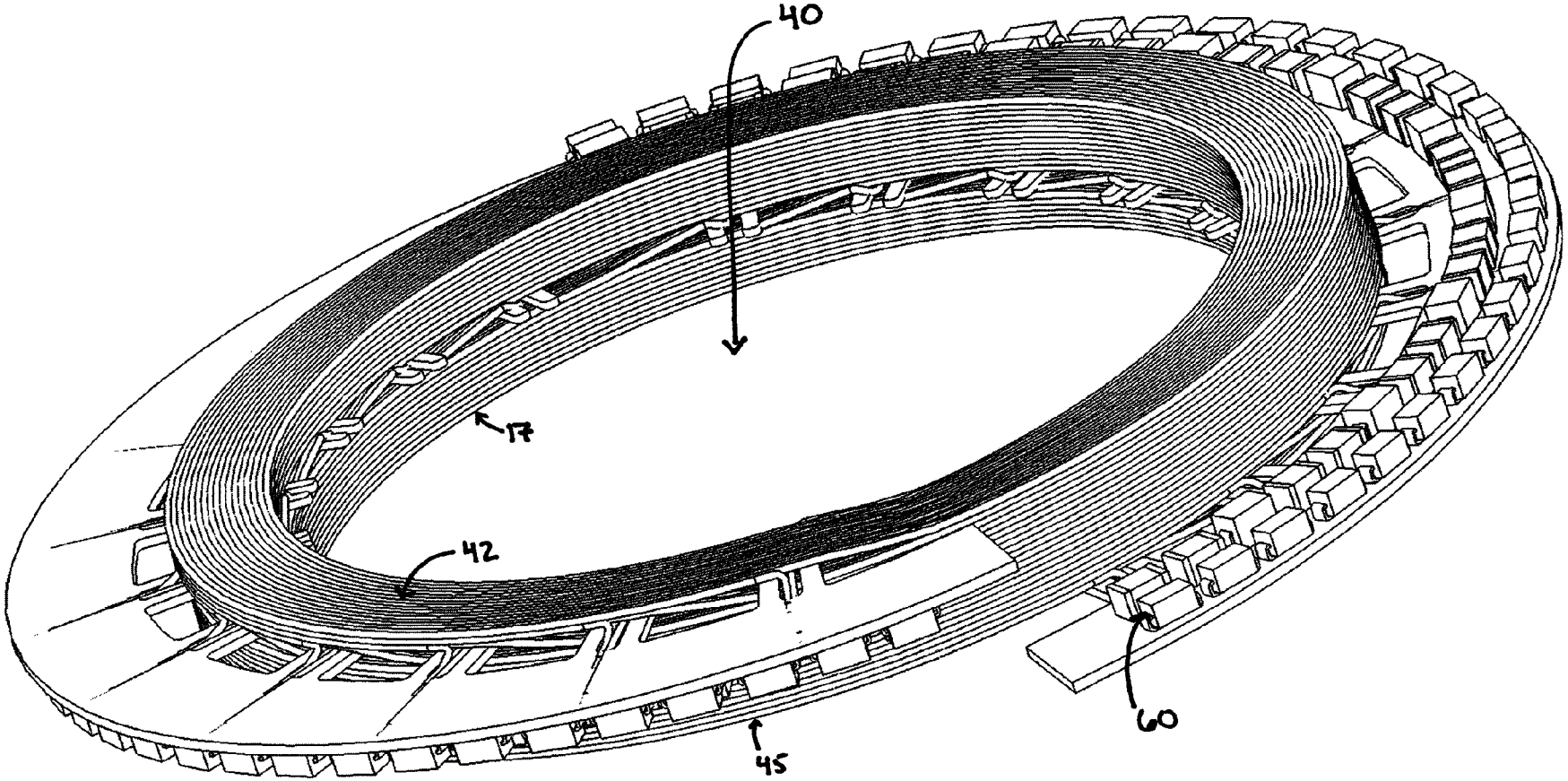
FIG. 4 is an illustration of the embodiment of FIG. 3 further including rectifiers.

In such an embodiment, the start lead 20 and finish lead 30 of each adjacent winding 10 in the stack of windings 12 is indexed with respect to the start lead and finish lead of each adjacent winding in the stack of windings. Such indexing of the start lead and finish lead allows for greater access to the start and finish leads, while also allowing for more compact design in attaching rectifiers 60 around the exterior of the stack of windings. See, for example, FIG. 4.

Figure 6:
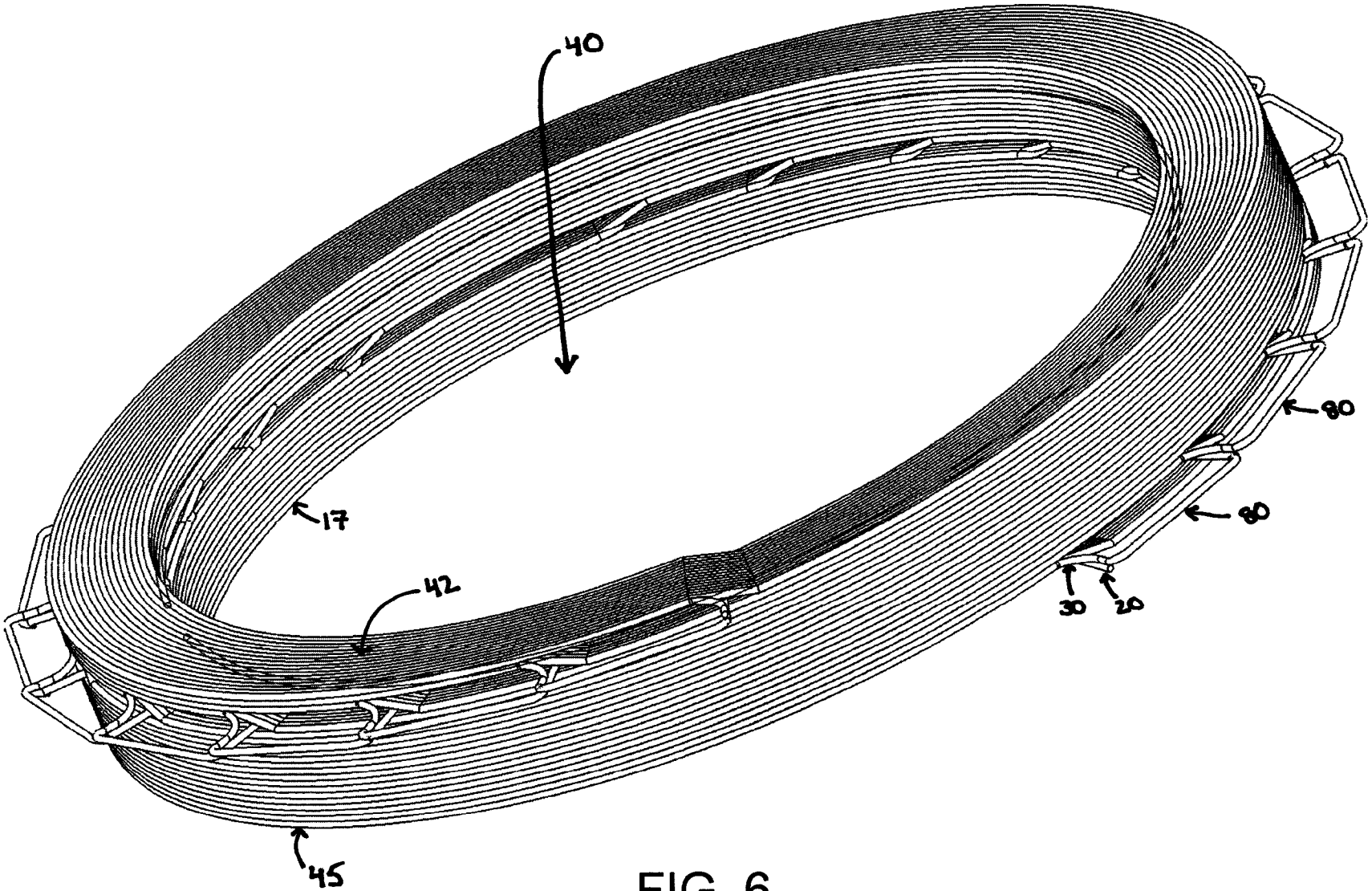
FIG. 6 is an exemplary embodiment of the present invention showing connections between multiple stacks of windings.

As shown in FIG. 6, the finish lead 30 of a particular multiple-turn coil may be connected to the start lead 20 of an immediately adjacent multiple turn coil via a conductor 80.

As should be evident based on the above description and associated figures, in the various exemplary embodiments of the present invention, the coils wind with an index, the index being defined by an adjacent coils of substantially similar form and circumference, or circumferentially, being substantially coplanar with adjacent coils, or tapered, having an index of a constant ratio of circumferential and normal components.

Figure 1:
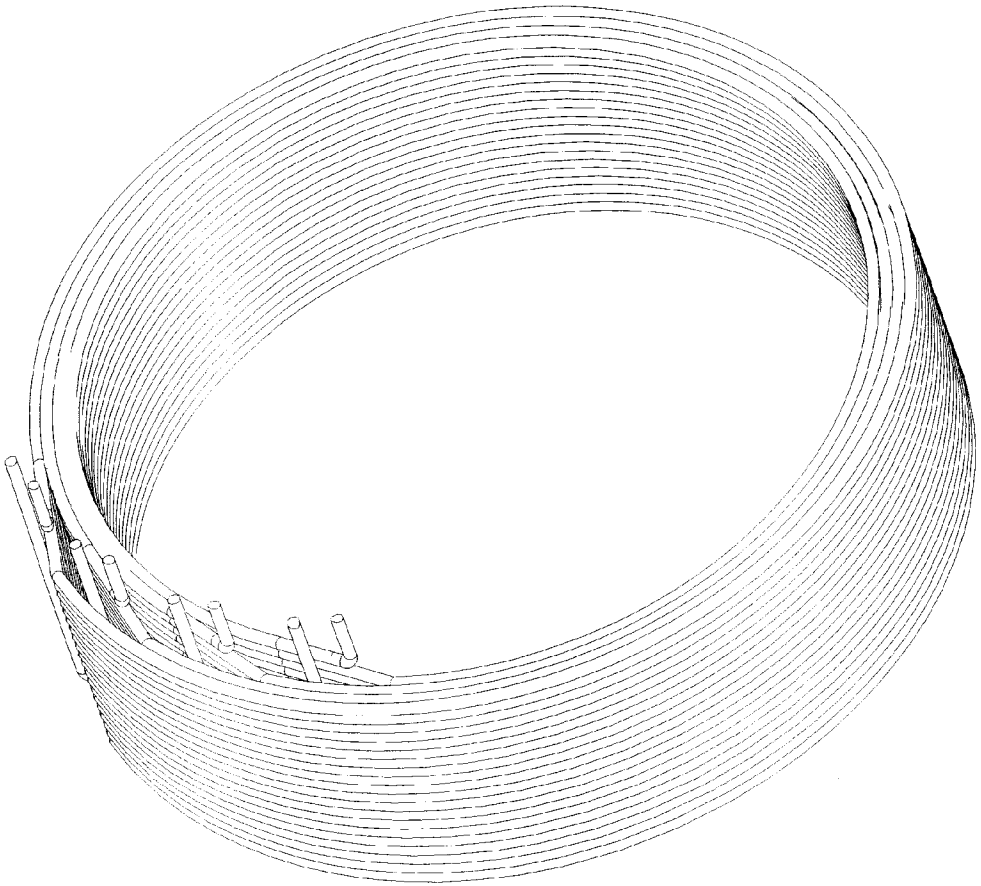
Prior Art FIG. 1
FIG. 1 is an illustration of prior art variation of a winding.

Further, in the prior art shown in FIG. 1, as additional windings are introduced, the circumference grows larger. As discussed above, space is becoming a precious commodity in the technology field as devices are becoming smaller and smaller. The present invention does not grow outwardly as addition windings are introduced, but instead grows in a direction substantially perpendicular to the circumference.

In other embodiments of the present invention, the multiple-turn coil may have a substantially planar shape. That is, the first turn of the multiple-turn coil is substantially in the same plane as the turn of the multiple-turn coil closest to the exterior.

Figure 5:
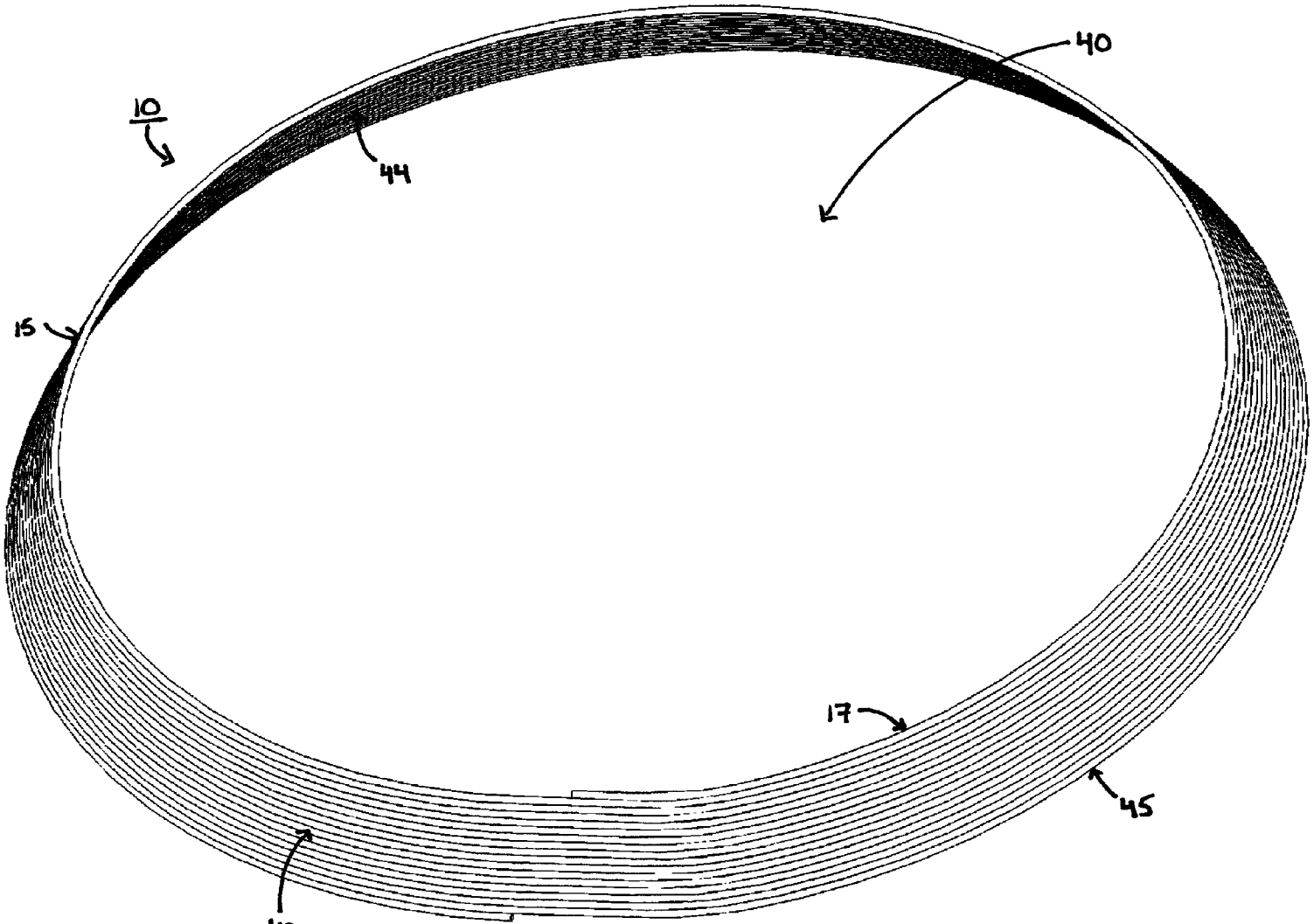
FIG. 5 is another exemplary embodiment of the present invention.

However, as represented with a single winding in FIG. 5, the multiple-turn coil may possess an overall substantially conical shape. In FIG. 5, for example, the first turn of the multiple-turn coil may be considered a narrower portion of the substantially conical shape, and the last turn of the coil may be considered the widest portion, such that each subsequent turn of the coil resides in a different plane.

In FIG. 5, the multiple-turn coil is substantially convex in its conical shape. However, it should be understood that the same multiple-turn coil could instead be substantially concave in its conical shape.

If desired, a multiple-turn coil according to the various exemplary embodiments of the present invention could be a combination of turns of a single winding being substantially planar or conical.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A stack of two or more windings within a magnetic circuit, wherein each winding is comprised of a multiple-turn coil having a start lead and a finish lead, the multiple-turn coil extending either outward or inward from a center region; wherein a first turn of the coil is connected to the start lead and has a smallest perimeter from the center region and at least one subsequent turn of the coil has a progressively greater perimeter, such that the start lead passes over or under adjacent larger turns of the coil to extend to the exterior perimeter of the winding, or the finish lead passes over or under adjacent larger turns of the coil to extend to the interior of the winding; wherein the location of an extension of either the start lead or the finish lead of each winding of the stack are varied along the perimeter with respect to each adjacent winding of the stack, and the multiple-turn coil is substantially planar or conical in shape.

2. The stack according to claim 1, wherein either the start lead or the finish lead of a first multiple-turn coil is connected in series or parallel to either the start lead or finish lead of at least a second multiple-turn coil via a conductor.

3. The stack according to claim 2, wherein current flowing through the first multiple-turn coil and the second multiple-turn coil is made to flow through one or more rectifiers.

4. The stack according to claim 3, wherein the rectifiers are mounted directly adjacent to the exterior perimeter of the stack.

5. The stack according to claim 3, wherein the rectifiers are connected in series.

6. The stack according to claim 3, wherein the rectifiers are connected in parallel.

7. The stack according to claim 1, wherein current flowing through the multiple-turn coil is made to flow through one or more rectifiers.

8. The stack according to claim 7, wherein the rectifiers are mounted directly adjacent to the exterior perimeter of the stack.

9. The stack according to claim 7, wherein the rectifiers are connected in series.

10. The stack according to claim 7, wherein the rectifiers are connected in parallel.

11. A stack of two or more windings within a magnetic circuit, wherein each winding is comprised of a multiple-turn coil having a start lead and a finish lead, the multiple-turn coil extending either outward or inward from a center region, and the multiple-turn coil is substantially planar or conical in shape; wherein a first turn of the coil is connected to the start lead and has a smallest perimeter from the center region and at least one subsequent turn of the coil has a progressively greater perimeter, such that the start lead passes over or under adjacent larger turns of the coil to extend to the exterior perimeter of the winding, or the finish lead passes over or under adjacent larger turns of the coil to extend to the interior of the winding; wherein the location of an extension of either the start lead or the finish lead of each winding of the stack are varied along the perimeter with respect to each adjacent winding of the stack, and a height of the stack is substantially reduced due to forming adjacent coils to be positioned against one another in locations where neither the start leads nor the finish leads are passing between coils.

12. The stack according to claim 11, wherein either the start lead or the finish lead of a first multiple-turn coil is connected in series or parallel to either the start lead or finish lead of at least a second multiple-turn coil via a conductor.

13. The stack according to claim 12, wherein current flowing through the first multiple-turn coil and the second multiple-turn coil is made to flow through one or more rectifiers.

14. The stack according to claim 13, wherein the rectifiers are mounted directly adjacent to the exterior perimeter of the stack.

15. The stack according to claim 13, wherein the rectifiers are connected in series.

16. The stack according to claim 13, wherein the rectifiers are connected in parallel.

17. The stack according to claim 11, wherein current flowing through the multiple-turn coil is made to flow through one or more rectifiers.

18. The stack according to claim 17, wherein the rectifiers are mounted directly adjacent to the exterior perimeter of the stack.

19. The stack according to claim 17, wherein the rectifiers are connected in series.

20. The stack according to claim 17, wherein the rectifiers are connected in parallel.

* * * * *